United States Patent [19]

Barthelmes et al.

[11] Patent Number: 5,001,395

[45] Date of Patent: Mar. 19, 1991

[54] HIGH-PRESSURE DISCHARGE LAMP WITH CORROSION PROTECTED ELECTRODE LEADS

[75] Inventors: Clemens Barthelmes; Axel Bunk, both of Berlin, Fed. Rep. of Germany

[73] Assignee: Patent-Treuhand-Gesellschaft fur elektrische Glühlampen m.b.H., Munich, Fed. Rep. of Germany

[21] Appl. No.: 338,307

[22] Filed: Apr. 14, 1989

[30] Foreign Application Priority Data

Apr. 19, 1988 [DE] Fed. Rep. of Germany ... 8805183[U]

[51] Int. Cl.[5] ..... H01J 17/18

[52] U.S. Cl. ..... 313/623; 313/25; 313/641

[58] Field of Search ..... 313/25, 641, 623

[56] References Cited

U.S. PATENT DOCUMENTS 4,633,136 12/1986 Fromm et al. ..... 313/623
4,647,814 3/1987 Dobrusskin et al. ..... 313/641
4,691,142 9/1987 Dohmen ..... 313/623
4,717,852 1/1988 Dobrusskin et al. ..... 313/25
4,783,612 11/1988 Sprengers ..... 313/623

*Primary Examiner*—Donald J. Yusko
*Assistant Examiner*—Diab Hamadi
*Attorney, Agent, or Firm*—Frishauf, Holtz, Goodman & Woodward

[57] ABSTRACT

To protect tungsten electrode shafts (2, 3; 15, 16) extending into the a quartz glass discharge chamber (13, 27) of a high-pressure discharge lamp from attack by metal halides included in the fill to improve the color rendition of the discharge, the electrode shafts (2, 3; 15, 16) are tightly surronded by small tubes (11, 12; 25, 26) of electrically insulating material, which is highly temperature resistant, located in part within the press seal (10; 23, 24) and fitted against the ends of sealing foils (6, 7; 19, 20) which face the discharge chamber. The tube elements extend at least about 0.5 mm beyond the inner ends of the press seal (10; 23, 24) into the discharge chamber (13, 27) and are formed of a material which has a thermal coefficient of expansion which is not lower than that of quartz glass and not higher than that of tungsten.

10 Claims, 2 Drawing Sheets

HIGH-PRESSURE DISCHARGE LAMP WITH CORROSION PROTECTED ELECTRODE LEADS

Reference to related patents and patent application, the disclosure of which is hereby incorporated by reference, assigned to the assignee of the present application:

U.S. Pat. No. 4,633,136, Fromm et al

U.S. Pat. No. 4,717,852, Dobrusskin et al

U.S. Ser. No. 07/120,946, filed Nov. 16, 1987, now abandoned, Gosslar et al

U.S. Pat. No. 4,937,495, filed Jan. 13, 1989

U.S. Pat. No. 4,782,266, Heider et al

U.S. Pat. No. 4,647,814, Dobrusskin et al

The present invention relates to a high-pressure discharge lamp, and more particularly to a high-pressure discharge lamp which includes a fill of mercury, a noble gas, and metal halide additives which are selected to provide, in operation of the lamp, visible light of predetermined color temperature and color rendition.

BACKGROUND

Currently used high-pressure discharge lamps usually include metal halides to obtain desired color rendition. The metal halides have the characteristic that, in dependence on the particular type of halide used, and the quantity of the metal halide in the discharge chamber defined by the discharge vessel, their presence can lead to corrosion of the electrodes. Corrosion at the electrode results in removal of material from the electrode shafts. This material removal may continue to such an extent that the electrode shaft is sufficiently weakened, leading, eventually, to breakage of the electrode, and, hence, failure of the lamp.

U.S. Pat. No. 4,633,136, Fromm et al. assigned to the assignee of the present application and the disclosure of which is hereby incorporated by reference, describes a metal halide high-pressure discharge lamp in which, to strengthen the electrode shaft, the electrode shaft is surrounded by a cover of high temperature resistant metal. This cover is formed as a conical spiral or coil, in which the individual windings of the coils are placed closely against each other, and have one end thereof melted into the discharge vessel, for example into the press seal through which the electrode shaft extends. The presence of this coiled winding decreases material loss on the electrode by corrosion caused by the metal halides at the transition point between the electrode shaft and the press or pinch seal.

THE INVENTION

It is an object to improve the corrosion protection of the electrodes used in a high-pressure discharge lamp in which the discharge vessel includes a fill which was highly corrosive additives therein in order to provide light output at a desired color temperature, and in which the lifetime of the lamp is increased over previously known lamps. Additionally, the firing or ignition of the lamp should be ensured, particularly when the lamp is to be hot-started or hot-fired.

Briefly, the protection against electrode shaft failure due to corrosion is obtained by providing tubular elements of electrically insulating high-temperature resistant material, tightly surrounding the electrode shafts, the tubular elements being located in part within the press seal of the lamp and fitting against the end of the sealing foil, customarily used in such lamps, facing the discharge chamber. The insulating material sleeve extends at least by about ½ mm beyond the end of the press seal and into the discharge chamber.

Investigations have shown that corrosion primarily occurs at the region of the electrode shaft adjacent the press seal, that is, at the transition of the electrode shaft out of the press seal and into the discharge chamber. Use of a tube of electrically insulating material which closely surrounds the electrode shaft and extends from the sealing foil into the discharge chamber permits tight surrounding of the shaft as the pinch or press seal is made. This substantially improves the corrosion protection in the region of the press seal, and just therebeyond within the discharge chamber.

Suitable electrically insulating materials for the tube can be quartz glass or, in dependence on the type of high-pressure lamp, a highly $SiO_2$ containing glass such as Vycor (Trademark), or hard glass. Typically, the material of the discharge vessel is quartz glass, which has a thermal coefficient of expansion of $0.5\times10^{-6}K^{-1}$.

The overlap of the electrically insulating tube beyond the press seal and extending within the discharge chamber additionally prevents possible arc-over along the electrode shaft upon ignition, that is, arcing upon ignition along the pinch seal which mal-ignition may lead to bursting of the discharge vessel.

In accordance with a feature of the invention, the tubes are preferably made of a material which has a melting point somewhat below, e.g. slightly under that of the material for the discharge vessel, typically below quartz glass which has a softening temperature of 1580° C. Vycor with a softening temperature of about 1530° C. is a suitable material and provides particularly good tight surrounding of the electrode shaft, so that attack of the fill on the sealing foil is effectively inhibited.

Stresses in the region of the pinch or press seal due to the pinching or pressing operation can be held to a minimum if the thermal coefficients of expansion of the materials within the press seal are selected to have comparable values. It is of particular advantage, when using quartz as the material for the discharge vessel, to obtain a comparatively smooth transition from the quartz of the pinch seal to the metal of the electrode shaft, typically of tungsten, which has a thermal coefficient of expansion of $4.3\times10^{-6}K^{-1}$ by making the material of the insulating tube of a substance which has a thermal coefficient of expansion intermediate that of the quartz glass and that of the metal of the electrodes, i.e. no lower than that of the quartz glass and no higher than that of tungsten.

It is usually sufficient to surround the electrode shaft with a single tubular element made, uniformly, of one material. It is, however, also possible to use a composite tubular element or two tubular elements fitted axially against each other. If such an arrangement is selected, the portion of the tubular element, or that one which is closest to the sealing foil, should be made of a material of lower melting temperature than that of the quartz of the discharge vessel in order to obtain optimum sealing when the pinch or press seal is being made.

DRAWINGS ILLUSTRATING TWO EXEMPLARY EMBODIMENTS

FIG. 1 is a highly schematic front view of a single-ended discharge vessel, showing the components of the high-pressure discharge lamp only schematically; and FIG. 2 is a front view of a double-ended high-pressure discharge lamp.

DETAILED DESCRIPTION

Figure 1:
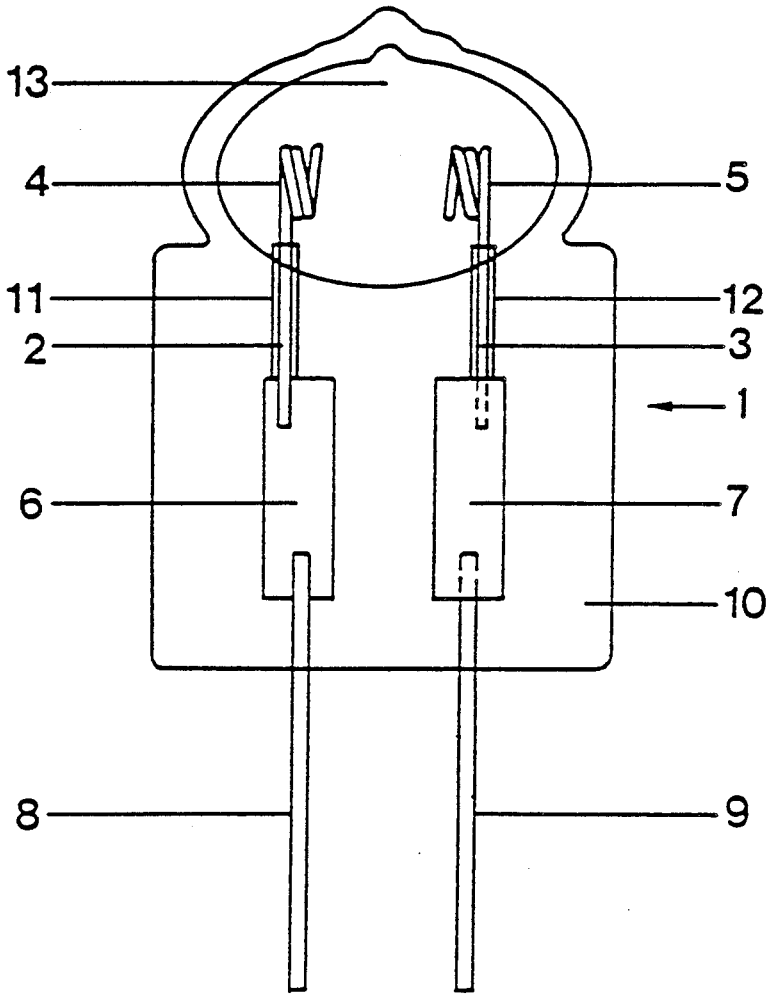

The discharge lamp 1 of FIG. 1 has a discharge vessel of quartz glass which defines a discharge chamber 13. The lamp 1 has two electrodes of tungsten material. Each one of the electrodes is formed of a straight shaft portion 2, 3 and an electrode head 4, 5. The electrode heads 4, 5 face each other, and are so made that the clear spacing between the electrode heads is less than that of the shaft portions 2, 3. The shaft portions 2, 3 are electrically connected, for example by welding, to sealing foils 6, 7, for example of molybdenum, which in turn are connected to external current supply leads 8, 9, for example also by welding. Leads 8, 9 are, typically, also of tungsten. The discharge vessel is closed off by a pinch or press seal 10. The press seal 10 completely surrounds and has pressed therein the ends of the electrode shafts 2, 3, the entirety of the sealing foils 6, 7 and the inner end portions of the external current supply leads 8. 9.

In accordance with the present invention, tubes 11, 12 of quartz surround the lower regions of the shaft portions 2, 3 of the inner electrodes. These tubes are threaded over the shaft portions 2, 3 before the pinch seal is made. Then, upon pinch-sealing the electrode assemblies, including the tubes 11, 12, the shaft portions 2, 3 are tightly surrounded by the pinch seal 10. The tubes 11, 12 are so placed that they seat against the ends of the foils 6, 7 facing the interior of the discharge vessel or of the discharge chamber. Their length is so determined that the tubes 11, 12 extend somewhat over the edge of the pinch seal 10 and into the discharge vessel 13. A suitable dimension is at least about ½ mm.

An outer bulb can be placed about the discharge vessel 1 and a base secured thereto. U.S. Pat. No. 4,717,854, assigned to the assignee of the present application and the disclosure of which is hereby incorporated by reference, shows a suitable arrangement and construction.

The table shows suitable dimensions for the protective tubes 11, 12 and for the electrode shafts for three single-ended discharge lamps of different power rating. In this table, the following abbreviations are used:

$d_a$: outer diameter (OD) of the tube 11, 12

$d_i$: inner diameter (ID) of the tube 11, 12

$l_R$: length of the tube 11, 12

$d_E$: thickness or diameter (d) of the electrode shaft portion 2, 3

$l_E$: length of the electrode shaft portion from the upper edge of the sealing foil 6, 7 to the edge of the pinch seal at the discharge chamber.

| Discharge Vessel | | Dimensions of Tubes 11, 12 (mm) | | | Dimensions of Electrode Shaft (mm) | |
|---|---|---|---|---|---|---|
| Power Rating (W) | Volume ($cm^3$) | $d_a$ | $d_i$ | $l_R$ | $d_E$ | $l_E$ |
| 35 | 0.08 | 0.75 | 0.30 | 2.2 | 0.25 | 1.7 |
| 70 | 0.28 | 0.90 | 0.44 | 4.0 | 0.40 | 4.3 |
| 150 | 0.68 | 1.00 | 0.55 | 4.8 | 0.50 | 4.3 |

Figure 2:
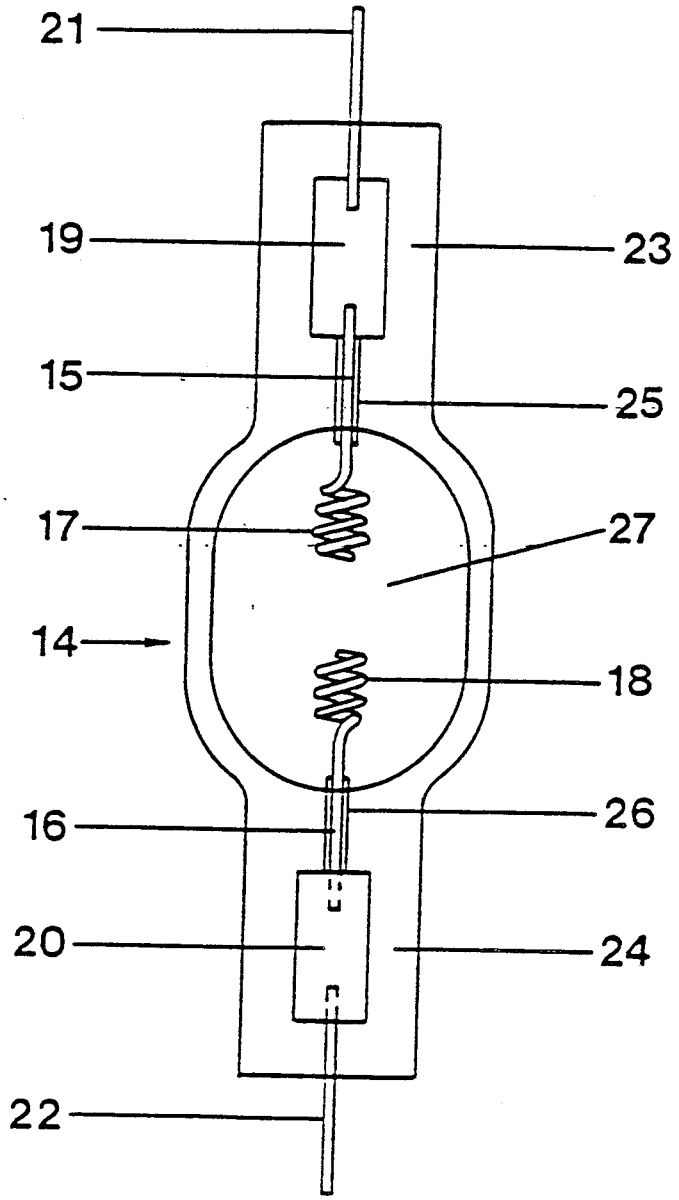

FIG. 2 illustrates a double-ended or double-pinch sealed lamp having a discharge vessel 14 with axially facing tungsten electrodes. Each electrode has an electrode head 17, 18 and an electrode shaft portion 15, 16. The ends of the electrode shafts 15, 16 are welded to molybdenum foils 19, 20, respectively. The outer ends of the molybdenum foils 19, 20 have current supply leads 21, 22, also of tungsten welded thereto. The discharge vessel 14 is closed off by two facing pinch or press seals 23, 24, each of which entirely encloses the sealing foils 19, 20 and the end portions of the electrode shafts 15, 16 as well as the inner end portions of the current supply leads 21, 22.

In accordance with a feature of the present invention, the electrode shafts 15, 16 are surrounded by tubes 25, 26 of quartz glass which, prior to welding of the electrodes to the molybdenum foils 19, 20 are pushed over the electrode shafts 15, 16. After making the respective subassemblies of outer leads 21, 22, molybdenum foils 19, 20, and electrode shafts 15, 16 with the tubes 25, 26 thereon, the assemblies are arranged with respect to the quartz glass vessel 14 and the vessel is then pinch-sealed. As can be seen, the tubes 25, 26 are seated with their ends against the sealing foils 19, 20 and, upon pinch or press-sealing, the tubes 25, 26 of quartz tightly surround the electrode shafts, while extending somewhat over the ends of the pinch seals 23, 24 into the discharge chamber 27.

The discharge vessel 14 can be surrounded by an outer bulb, and provided with a base, so that the finished high-pressure discharge lamp will be obtained which is shown, for example, in U.S. Pat. No. 4,633,136, the disclosure of which is incorporated by reference.

The fill for the discharge chamber of the lamps shown both in FIGS. 1 and 2 includes a noble gas and mercury and, in addition, metal halides, for example an iodide and or a bromide of at least one of the metals of sodium, tin, thallium, indium and lithium. Tin iodide or tin bromide provides particularly good light output while, unfortunately, at the same time being particularly corrosive; it attacks the electrode shafts unless protected by the protective tubes 11, 12; 25, 26.

Various changes and modifications may be made within the scope of the inventive concept, and any features described in connection with any one of the embodiments may be used with the other.

We claim:

1. High-pressure discharge lamp having a discharge vessel (1, 14) of quartz glass defining a discharge chamber (13, 27);

a fill of noble gas, mercury, and at least one color temperature controlling metal halide additive within the discharge chamber;

at least one press seal (10; 23, 24) sealing the discharge vessel;

sealing foils (6, 7; 19, 20) located in the at least one press seal;

electrode shafts (2, 3; 15, 16) comprising tungsten electrically connected to the sealing foils and extending from the press seal into the discharge chamber, and where-in the improvement comprises, in accordance with the invention, tube elements (11, 12; 25, 26) of electrically insulating high-temperature resistant material tightly surrounding the electrode shafts, said tube elements being located in part within the press seal (10; 23, 24) and fitting against the end of the sealing foil (6, 7; 19, 20) which faces the discharge chamber, extend at least about 0.5 mm beyond the end of the press seal (10; 23, 24) into the discharge chamber, and are formed of a material which has a thermal coefficient of expansion which is not lower than that of quartz glass and
not higher than that of tungsten.

2. The lamp of claim 1, wherein the tube elements (11, 12) comprise a material having a melting point which is lower than that of quartz glass.

3. The lamp of claim 1, wherein the material of the tube elements (11, 12; 25, 26) has a thermal coefficient of expansion which is intermediate that of the material of the discharge vessel (1, 14) and of the electrode shafts (2, 3; 15, 16).

4. The lamp of claim 1, wherein the tube elements (11, 12) comprise a material having a melting point which is lower than that of the material of the quartz glass vessel (1, 14).

5. The lamp of claim 2 wherein the material of the tube elements (11, 12; 25, 26) has a thermal coefficient of expansion which is intermediate that of the material of the quartz glass vessel (1, 14) and of the electrode shafts (2, 3; 15, 16).

6. The lamp of claim 2, wherein said material of the tube elements (11, 12; 25, 26) has a melting point slightly lower than that of quartz glass.

7. The lamp of claim 2, wherein said material of the tube elements (11, 12; 25, 26) has a melting point just under and close to that of quartz glass.

8. The lamp of claim 1, wherein said material of the tube elements (11, 12; 25, 26) has a thermal coefficient of expansion between $4.3 \times 10^{-6} K^{-1}$ and $0.5 \times 10^{-6} K^{-1}$.

9. The lamp of claim 1, wherein said material of the tube elements (11, 12; 25, 26) is quartz glass.

10. The lamp of claim 1, wherein said material of the tube elements (11, 12; 25, 26) is high silicon oxide containing glass.

* * * * *